US005336451A

United States Patent [19]

Lovick

[11] Patent Number: 5,336,451

[45] Date of Patent: Aug. 9, 1994

[54] DESUPERHEATER APPARATUS AND METHOD

[75] Inventor: James M. Lovick, Fernandina Beach, Fla.

[73] Assignee: ITT Rayonier, Inc., Stamford, Conn.

[21] Appl. No.: 164,624

[22] Filed: Dec. 8, 1993

Related U.S. Application Data

[63] Continuation of Ser. No. 7,741, Jan. 22, 1993, abandoned.

[51] Int. Cl.[5] ..... B01F 3/04

[52] U.S. Cl. ..... 261/116; 261/DIG. 13

[58] Field of Search ..... 261/116, DIG. 13

[56] References Cited

U.S. PATENT DOCUMENTS

| | | | |
|---|---|---|---|
| 1,773,054 | 8/1930 | McDermet | 261/DIG. 13 |
| 2,530,638 | 11/1950 | White | 261/DIG. 13 |
| 3,219,323 | 11/1965 | Spence | 261/DIG. 13 |
| 3,732,851 | 5/1973 | Self | 261/DIG. 13 |
| 3,931,371 | 1/1976 | Maurer et al. | 261/DIG. 13 |
| 3,981,946 | 9/1976 | Soya et al. | 261/DIG. 13 |
| 4,828,767 | 5/1989 | Smirnoff | 261/DIG. 13 |

*Primary Examiner*—Tim Miles

*Attorney, Agent, or Firm*—Arthur L. Plevy; Thomas N. Twomey

[57] ABSTRACT

The present invention inserts and retrieves a desuperheating assembly from within a pressurized steam header through an existing conduit that joins the steam header to the surrounding environment. A gate valve is disposed within the connecting conduit obstructing access to the steam header when closed. The spray nozzle of the desuperheating assembly is attached to a fluid supply pipe and is placed within the conduit on the side of the gate valve that is exposed to the ambient environment. A gas impervious seal is produced between the conduit and the fluid supply pipe so as to isolate the spray nozzle between the gate valve and the gas impervious seal. The gate valve is opened exposing the spray nozzle to the steam header. The supply pipe is advanced past the gas impervious seal, which in turn, drives the spray nozzle into the steam header. Water or steam atomized water can be supplied to the spray nozzle from an external source through the supply pipe that extends from the spray nozzle within the steam header, past the gas impervious seal, to a point external of the vessel. When retrieving the spray nozzle from within the steam header, the supply pipe is retracted past the gas impervious seal within the connecting conduit. As such, the spray nozzle is retracted into the connecting conduit past the gate valve. The gate valve is closed and the spray nozzle is isolated from the steam header. The pressure surrounding the spray nozzle is vented to ambient and the spray nozzle can then be removed without adversely effecting the flow of steam within the steam header. The spray nozzle can then be repaired or replaced and returned into the steam header as described.

5 Claims, 6 Drawing Sheets

DESUPERHEATER APPARATUS AND METHOD

This is a continuation of application Ser. No. 08/007,741, filed on Jan. 22, 1993, entitled DESUPERHEATER APPARATUS, now abandoned.

FIELD OF THE INVENTION

The present invention relates to desuperheating devices that are used to reduce the temperature of superheated steam by the injection of water or steam atomized water, and more particularly to such desuperheating devices that can be selectively introduced within, or removed from, a steam header without having to stop the flow of steam within the header.

BACKGROUND OF THE INVENTION

Many industrial and commercial facilities produce superheated steam to drive turbines or perform other desired functions. Before the spent steam is returned to the boilers, the steam is often used throughout a facility as general process steam. Process steam can be used to heat the facility or can be used as a source of heat in various types of equipment such as thermocycle chambers, industrial drying machines and the like. In many applications, process steam is most efficiently utilized when the temperature of the steam is at, or near, the saturation temperature for its pressure. Desuperheating refers to the process of reducing the temperature of the superheated steam to a temperature near its saturation temperature.

An economical way to desuperheat steam is through the injection of water or steam atomized water, wherein relatively cool water or watervapor is directed into the steam header. The superheated steam expends energy evaporating and heating the injected water, as such the superheated steam is cooled in proportion to the temperature and volume of the fluid being injected. A disadvantage of desuperheating by water injection is that the atomizing orifice, used to create the discharging mist of either water or steam atomized water, requires frequent maintenance. As such, the atomizing orifice must be frequently replaced within the steam header.

Referring to FIG. 1, there is shown a conventional prior art desuperheater assembly 10 in conjunction with a steam header 12. The desuperheater assembly 10 is comprised of an elongated supply pipe 14 having a connecting flange 16 at one end and a spray nozzle 18 at the opposite end. The connecting flange 16 is coupled to a water supply line 20 that supplies water or steam atomized water through the supply pipe 14 to the spray nozzle 18. A steam header connecting flange 22 is radially disposed at a set position near the top of the supply pipe 14. The steam header connecting flange 22 is bolted to a side conduit flange 23 that leads into the steam header 12. The supply pipe 14 is dimensioned to extend through the side conduit flange 23 and support the spray nozzle 18 in the center of the steam header 12, as the steam header connecting flange 22 is bolted onto the side conduit flange 23.

The steam header connecting flange 22 is bolted to the side conduit flange 23 in a conventional manner. As such, to remove the desuperheater assembly 10 from the steam header 12, the flow of steam through the steam header 12 must be stopped and the pressure within the steam header 12 brought to ambient. At this point, the desuperheater assembly 10 can be unbolted and removed. The isolation of the steam header 12 is continued until a substitute desuperheater assembly 10 can be installed or until the needed repairs can be made to the original desuperheater assembly 10. In the prior art, steam headers are isolated either by bypassing the steam header through other pipes or stopping the production of steam throughout the entire system. When the effected steam header containing the desuperheater assembly is bypassed, the process steam is not properly cooled. This often causes operational problem in various systems that utilize the process steam and are designed to run on desuperheated steam. Additionally, the ability to bypass a desired steam header requires redundant piping, which greatly increases the cost and complexity of building the original steam system. Consequently, isolating the steam header that contains the desuperheater assembly is not always a viable option. In the prior art, the other alternative is to stop steam production or vent steam production, thereby stopping the flow of process steam through the facility. When the flow of process steam stops, production with the facility is often stopped. Consequently, maintenance to the desuperheater assemblies is typically passed over in favor of maintenance to the boilers, turbines or other complex production equipment. Furthermore, since maintenance to the desuperheater assemblies must wait for a disruption in steam production, maintenance to the desuperheater assemblies cannot be performed when desired. As such, the desuperheater assemblies often operate in need of maintenance, which reduces the overall efficiency of the steam system within the facility.

It is therefore an object of the present invention to provide a desuperheater assembly that can be removed from, or inserted within, a steam header without having to isolate the flow of steam through the steam header.

SUMMARY OF THE INVENTION

The present invention is a device and method for accessing an object held within a pressurized vessel, without adversely effecting the pressure within the vessel. The present invention is particularly applicable to the insertion and removal of desuperheating devices from within steam headers.

The present invention inserts and retrieves a desuperheating assembly from within a pressurized steam header, through an existing conduit that joins the steam header to the surrounding environment. A gate valve is disposed within the connecting conduit, obstructing access to the steam header when closed. The spray nozzle of the desuperheating assembly is attached to a water supply pipe and is placed within the conduit on the side of the gate valve that is exposed to the ambient environment. A gas impervious seal is created between the conduit and the water supply pipe so as to isolate the spray nozzle between the gate valve and the gas impervious seal. The gate valve is then open exposing the spray nozzle to the steam header. The supply pipe is advanced past the gas impervious seal, which in turn, drives the spray nozzle into the steam header. Water or steam atomized water can be supplied to the spray nozzle from an external source through the supply pipe that extends from the spray nozzle within the steam header, past the gas impervious seal, to a point external of the vessel.

When retrieving the spray nozzle from within the steam header, the supply pipe is retracted past the gas impervious seal within the connecting conduit. The spray nozzle is retracted into the connecting conduit past the gate valve by the movement of the supply pipe. Once past the gate valve, the gate valve is closed and the spray nozzle is isolated from the steam header. The pressure surrounding the spray nozzle is vented to ambient and the spray nozzle can then be removed without adversely effecting the flow of steam within the steam header. The spray nozzle can then be repaired or replaced and returned into the steam header.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE INVENTION

Although the present invention can be used in many applications where it is desired to insert an elongated object into a vessel that retains gas or liquid under high pressure, it is especially suitable for use in connection with positioning a desuperheating spray nozzle assembly within a steam header. Accordingly, the present invention will be described in connection with inserting and removing a desuperheating spray nozzle from within a steam header.

Figure 1:
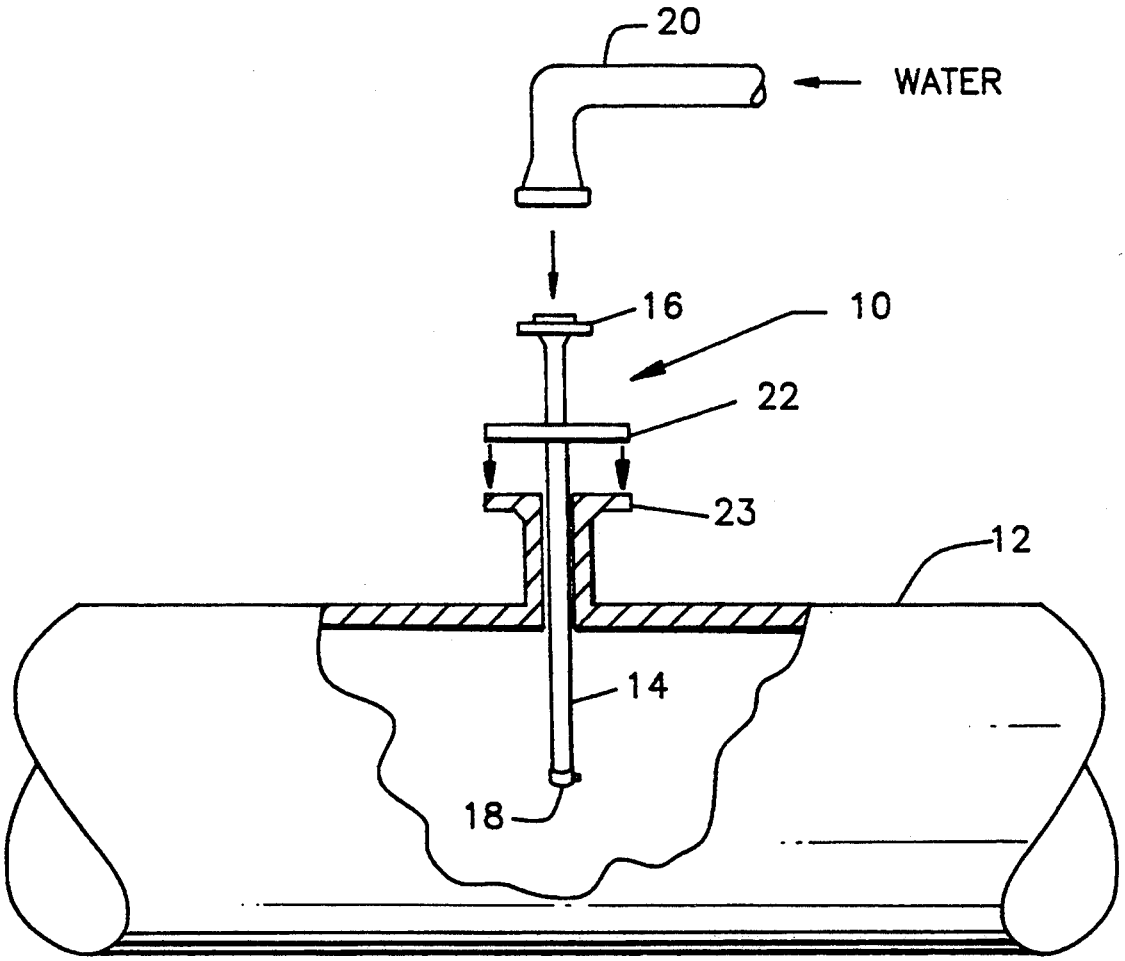
(PRIOR ART) FIG. 1
FIG. 1 is a partially exploded view of a prior art desuperheater assembly.
Figure 2:
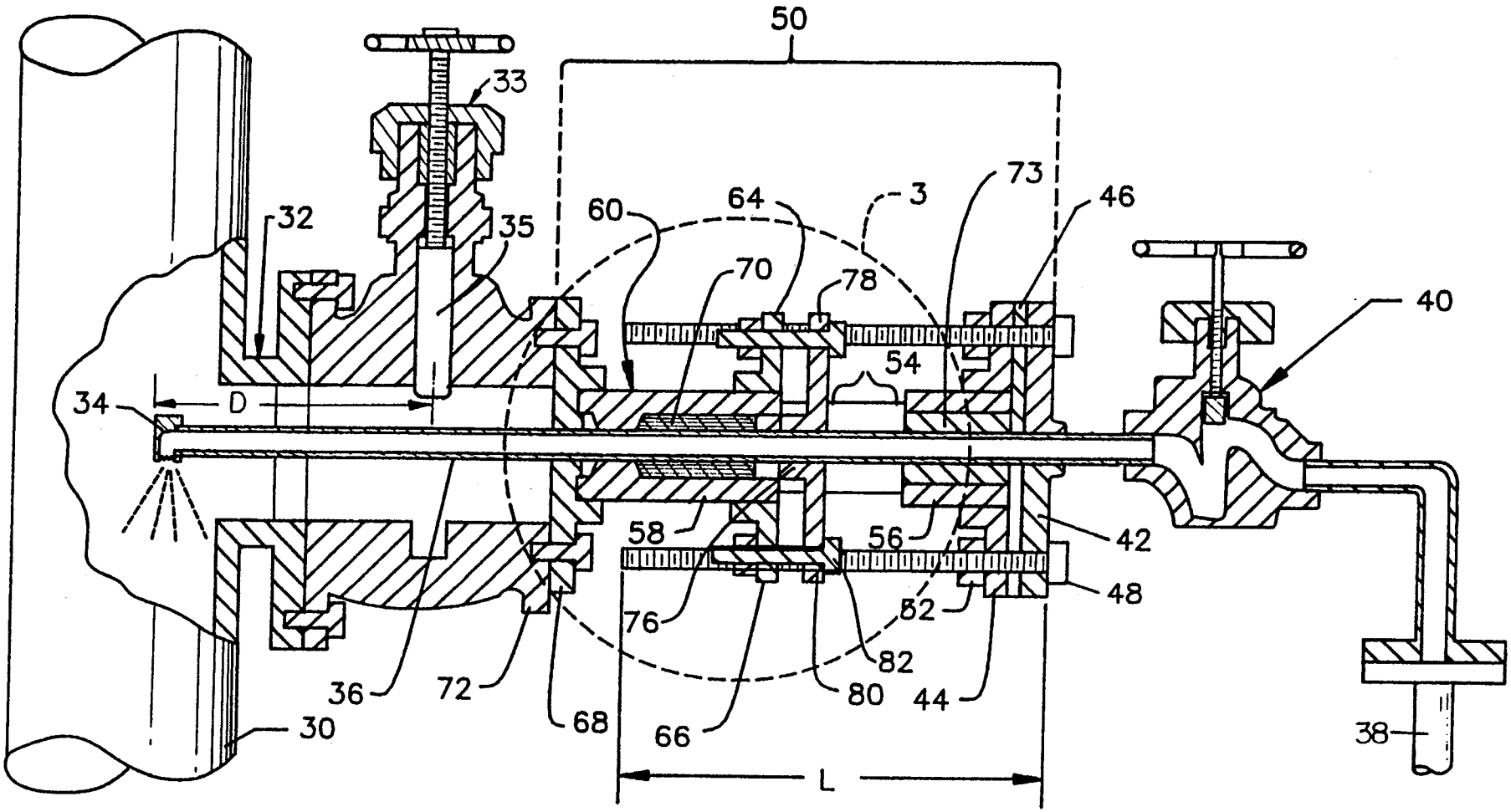
FIG. 2 is a cross-sectional view of one preferred embodiment of the present invention desuperheater assembly.

Referring to FIG. 2, there is shown a steam header 30 used to transport superheated steam. A flange pipe 32 extends from the steam header 30 and is joined to a gate valve 33 that can control the flow of steam through the flange pipe 32. In the shown embodiment, the gate valve 33 is fully opened and a supply pipe 36 extends into the steam header 30 through both the gate valve 33 and the flange pipe 32. The supply pipe 36 terminates within the steam header 30 at a spray nozzle 34. When in operation, the spray nozzle 34 is suspended in the center of the steam header 30 a distance D below the closeable gate 35 of the gate valve 33. As with the prior art embodiment of FIG. 1, the spray nozzle 34 discharges a mist of relatively cool water or steam atomized water into the steam header 30, thereby cooling the temperature of the superheated steam within the header 30 in proportion to the temperature and the volume of the fluid discharged. The supply pipe 36 supports the spray nozzle 34 within the steam header 30 and couples the spray nozzle 34 to a water supply line 38 that supplies the water to be discharged. A control valve 40, capable of obstructing the supply pipe 36, is disposed along the supply pipe 36 for a purpose which will later be described.

A supply pipe flange 42 is disposed around the supply pipe 36 just below the control valve 40. The pipe flange 42 is welded or otherwise securely attached to the supply pipe 36, preventing the independent movement of the supply pipe 36 relative the supply pipe flange 32. The supply pipe flange 32 is coupled to the gate valve 33 via a connector assembly 50. As will be explained, it is the connector assembly 50 that enables the spray nozzle 34 to be safely inserted or removed from the steam header 30, past the gate valve 33, regardless to the pressure differential that exists between the superheated steam within the steam header 30 and the surrounding ambient air.

Figure 3:
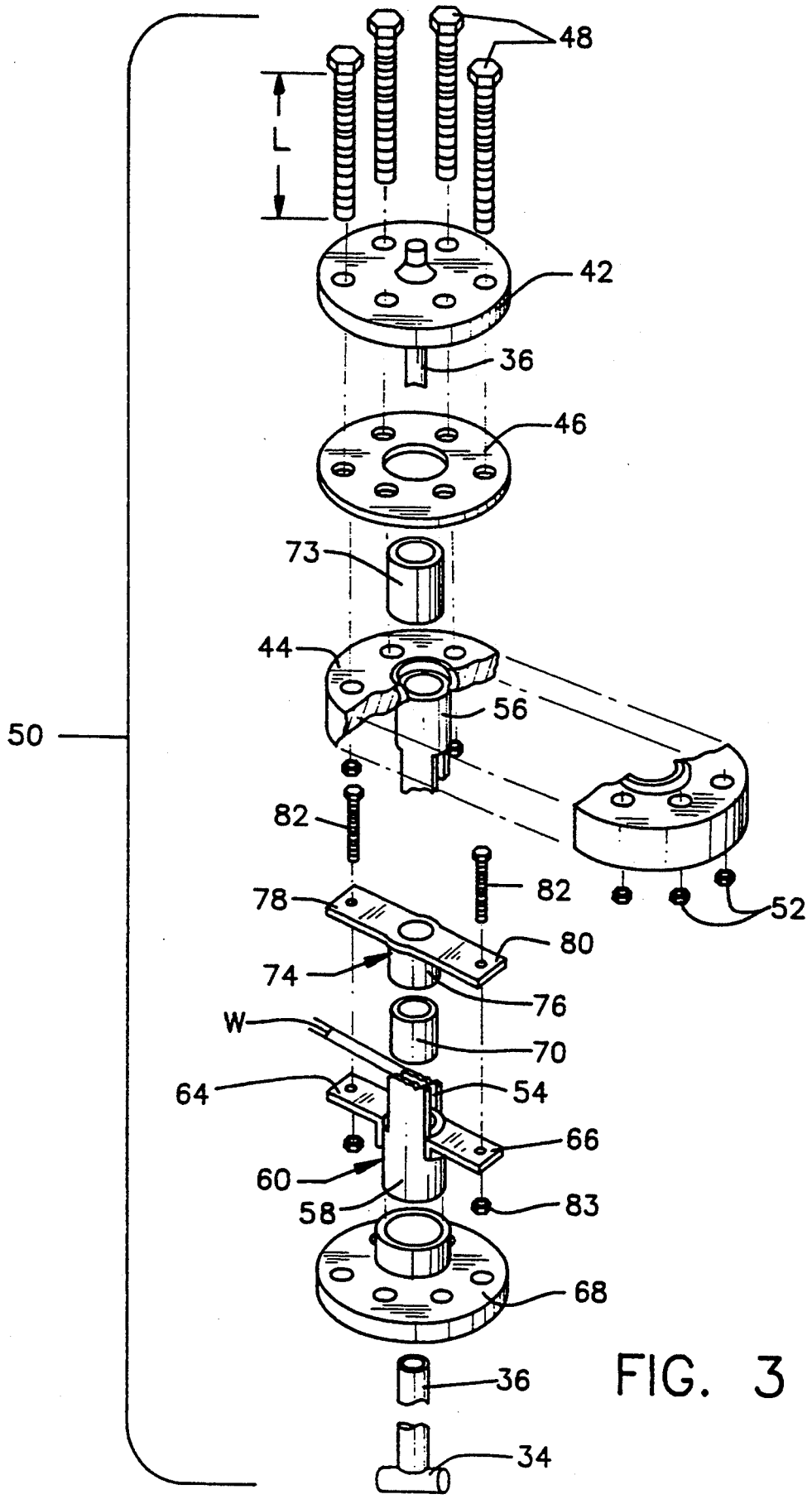
FIG. 3 is an enlarged cross-sectional view of the portion of the present invention contained within circle 3 as shown in FIG. 2.

Referring to FIG. 3, in conjunction with FIG. 2 it can be seen that the supply pipe flange 42, is bolted onto a similarly shaped lower face flange 44 that is part of the connector assembly 50. An optional gasket 46 is disposed between the supply pipe flange 42 and the face flange 44 and is compressed between the supply pipe flange 42 and the face flange 44 as the supply pipe flange 42 is bolted onto the face flange 44. The supply pipe flange 42 is bolted onto the face flange 44 utilizing a plurality of elongated bolts 48. For a reason to be later explained, each of the bolts 48 has a shaft length L that is longer than the distance D that the spray nozzle 34 extends below the closeable gate 35 of the gate valve 33, as shown in FIG. 2. The length of the overall connecter assembly 50 is longer than the shaft length L of the elongated bolts 48 so that the elongated bolts 48 do not engage the connector flange 68 at the distal end of the connector assembly 50 when the elongated bolts 48 are fully tightened. The elongated bolts 48 can be secured below the face flange 44 with locking nuts 52, as is shown, or the face flange 44 may include tapped apertures into which the bolts 48 may be directly threadably engaged.

The face flange 44 is welded or otherwise securely attached to upper end of a tubular member 60. The tubular member 60 is generally cylindrically shaped, except segments of the cylinder have been removed in the center region of the tubular member 60 producing an open slot 54 with a width W, that traverses the central region of the tubular member 60. As such, the tubular member 60 has a cylindrical upper region 56, upon which the face flange 44 is welded, a cylindrical lower region 58 and a central region wherein opposite segments of the cylindrical structure have been removed to create the open slot 54. Two L-shaped brackets 64, 66 are welded, or other wise securely attached to the lower region 58 of the tubular member 60 proximate the open slot 54. The L-shaped brackets 64, 66 are aligned with the open slot 54 so as to extend radially from the lower region 58 of the tubular member 60 just below both sides of the slot 54. A connector flange 68 is welded or otherwise securely affixed to the lower region 58 of the tubular member 60. The connector flange 68 is shaped to be bolted onto an end flange 72 of the gate valve 33 in a conventional manner. As such, the tubular member 60 is bolted at one end to the gate valve 33, via the connector flange 68, and the tubular member 60 is bolted at its opposite end to the supply pipe flange 42, via the face flange 44.

An optional bearing member 73 is press fit, welded or otherwise secured within the upper region 56 of the tubular member 60. The bearing member 73 is tubular having an inner diameter that is only slightly larger than the outer diameter of the supply pipe 38. The bearing member 73 can be formed of any material amenable to wear, whereby the bearing member 73 will support the supply pipe 38 during the lateral movements of the supply pipe 38, as will be later described. A packing gasket 70 is positioned within the lower region 58 of the tubular member 60. The packing gasket 70 is also tubular, having an inner diameter that generally matches the outer diameter of the supply pipe 38. A tamping bracket 74 is positioned above the packing gasket 70 within the tubular member 60. The tamping bracket 74 includes a central cylindrical member 76 that is sized to fit within the lower region 58 of the tubular member 60 above the packing gasket 70. Two arms 78, 80 extended in the horizontal from the central cylindrical member 76. Each of the arms 78, 80 extend through one side of the open slot 54 that is present in the central region of the tubular member 60. As such, the tamping bracket 74 is free to reciprocally move up and down in the center region of the tubular member 60 as guided by the arms 78, 80 passing through both sides of the open slot 54. The extending arms 78, 80 of the tamping bracket 74 protrude over the two L-shaped brackets 64, 68 that are welded to the sides of the lower region 58 of the tubular member 60. Bolts 82 pass through the arms 78, 80 on the tamping bracket 74 and join the tamping bracket 74 to the two L-shaped brackets 64, 68. The bolts 82 may pass through the L-shaped brackets 64, 68, as is shown, and can be secured by locking nuts 83, or the L-shaped brackets 64, 68 may included tapped apertures into which the bolts 82 can threadably engage.

Figure 4:
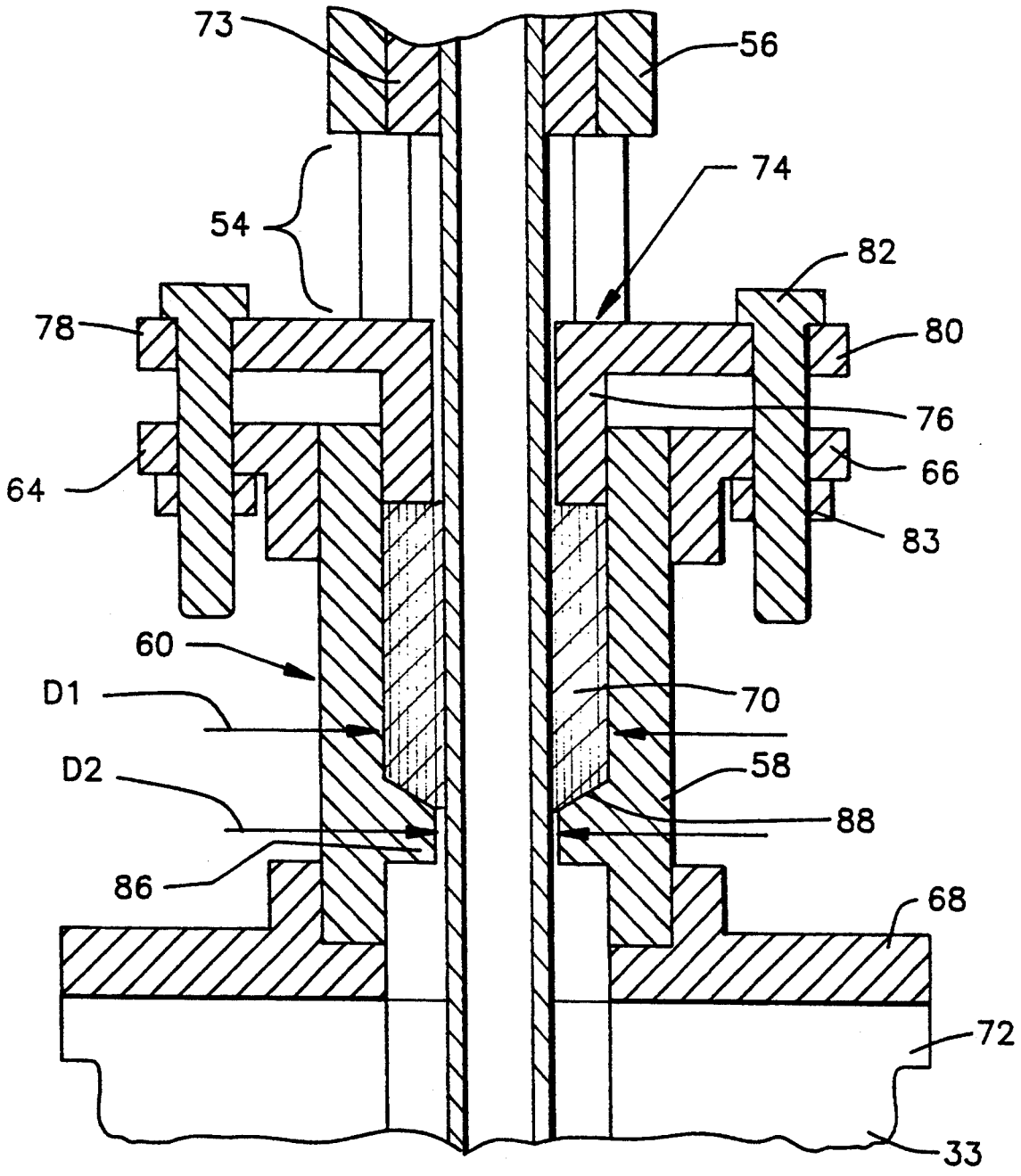
FIG. 4 is an exploded view of the preferred embodiment of the connector assembly components of the present invention.

The supply pipe 36 has a machined outer diameter, ensuring a consent outer diameter within the machining tolerances. The supply pipe 36 passes through the center of the tubular member 60 within the connector assembly 30 as the supply pipe 36 supports the spray nozzle 34 in the steam header 30. Consequently, the supply pipe 36 passes through the center of the bearing insert 73 in the upper region 56 of the tubular member 60, the central cylindrical member 76 of the tamping bracket 74 and the packing gasket 70 in the lower region 58 of the tubular member 60. Referring to FIG. 4, it can be seen that the lumen defined by the lower region 58 of the tubular member 60 has a complex shape whereby a inwardly disposed projection 86 extends from the inside surface of the lower region 58, making the inside diameter of the lower region 58 change from its initial diameter D1 to a restricted diameter D2. The restricted diameter D2 is smaller than the outer diameter of the packing gasket 70. As such, the packing gasket 70 rests upon the inwardly disposed projection 86 within the lower region 58 of the tubular member 60. The inwardly disposed projection 86 has a sloped top surface 88 that directs the packing gasket 70 against the supply pipe 36. The central cylindrical member 76 of the tamping bracket 74 enters the lower region 58 of the tubular member 60 above the packing gasket 70. As the tamping bracket 76 is drawn towards the L-shaped brackets 64, 68, at the sides of the lower region 58 by the tightening of bolts 82, the tamping bracket 74 compresses the packing gasket 70 against the sloped top surface 88 of the inwardly disposed projection 86. Consequently, the packing gasket 70 is forced against the supply pipe 36, wherein the packing gasket 70 can be selectively compressed to a point that creates a steam impervious seal against the supply pipe 36.

Figure 5:
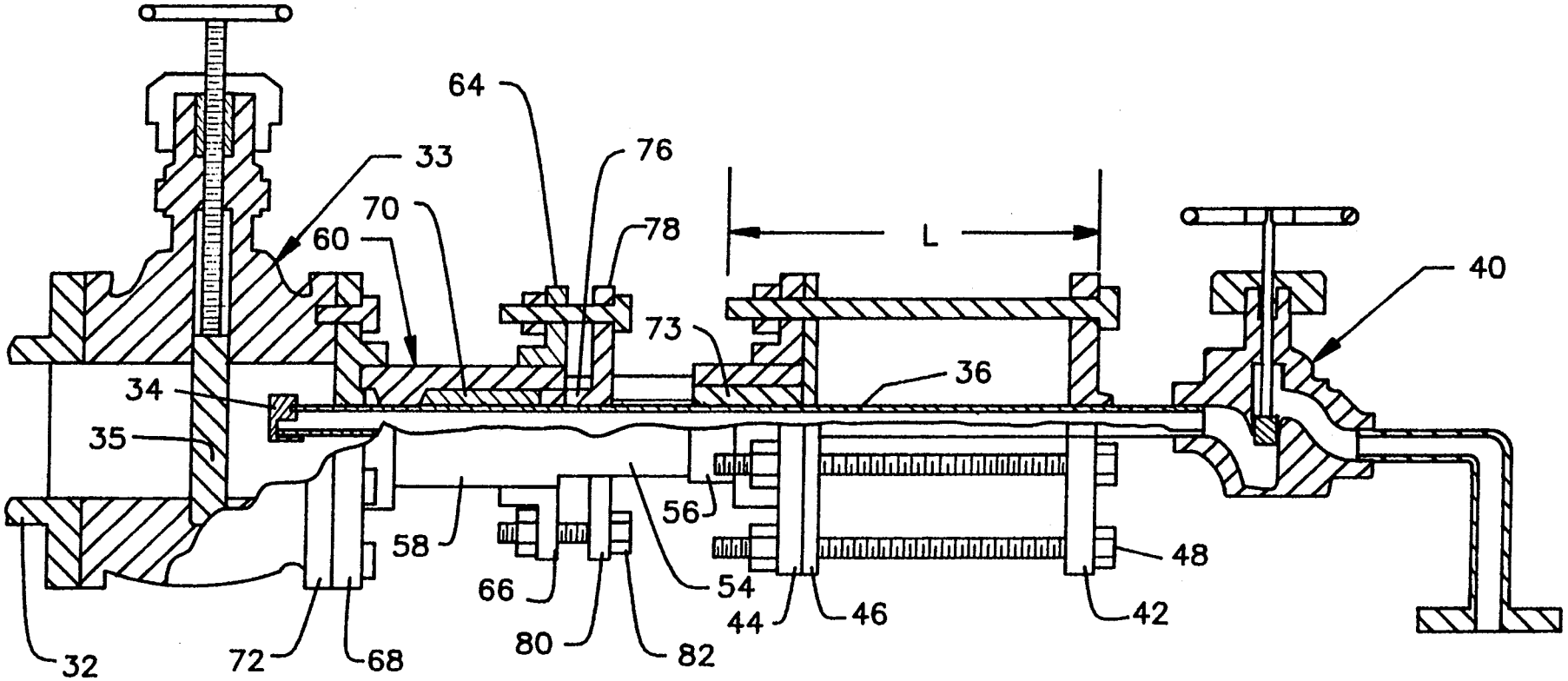
FIG. 5 is a selective cross-sectional view of the present invention desuperheater assembly as it would appear in a retracted position.

FIG. 2 shows the spray nozzle 34 properly positioned in the center of the steam header 30. The supply pipe 36 is joined to the water supply line 38 and the control valve 40 is open, allowing water to flow through the supply pipe 36 and out the spray nozzle 34. To remove the spray nozzle 34 from the steam header 30, the control vane 40 is closed (as shown in FIG. 5) and the supply pipe 36 is detached from the water supply line 38. The closed control valve 40 thereby prevents steam from the steam header 30 from escaping through the supply pipe 36. Referring to FIG. 5, the spray nozzle 34 is shown in its retracted position. To bring the spray nozzle 34 into this retracted position, the elongated bolts 48 joining the supply pipe flange 42 to the face flange 44 of the connector assembly 50 are loosened. The supply pipe flange 42 is biased away from the face flange 44 of the connector assembly 50 by the pressure differential that exists between the steam header 30 and the ambient air, wherein the pressure differential tries to drive the supply pipe 36 and spray nozzle 34 out of the flange pipe 32 past the gate valve 33. The length L of the elongated bolts 48 is longer than the distance D (see FIG. 2) that the spray nozzle 34 was suspended below the closeable gate 35 of the gate valve 33. Consequently, by loosening the elongated bolts 48 the spray nozzle 34 can be retracted to the side of the gate valve 33 proximate the connector assembly 50, as is shown. Once at this retracted position, the gate valve 33 is closed, isolating the supply pipe 36 and the spray nozzle 34 from the steam header 30. Since the movement of the supply pipe flange 42 is governed by the loosening of the elongated bolts 48, it will be understood that the bolts 48 will not all be loosened simultaneously. Consequently, the supply pipe flange 42 will experience a small degree of rocking as the elongated bolts 48 are loosened in sequence. As the supply pipe flange 42 is unbolted, the supply pipe 36 experiences a small degree of lateral movement. As such, the supply pipe 36 is forced against the bearing insert 73 within the upper region 56 of the tubular member 56. The beating insert 73 dampens the lateral movements of the supply pipe 36. Furthermore, the bearing insert 73 is more amenable to wear than is the supply pipe 36. Consequently, the wear due to contact is experienced by the bearing insert 73 and does not effect the dimensional tolerances of the outer diameter of the supply pipe 36.

Figure 6:
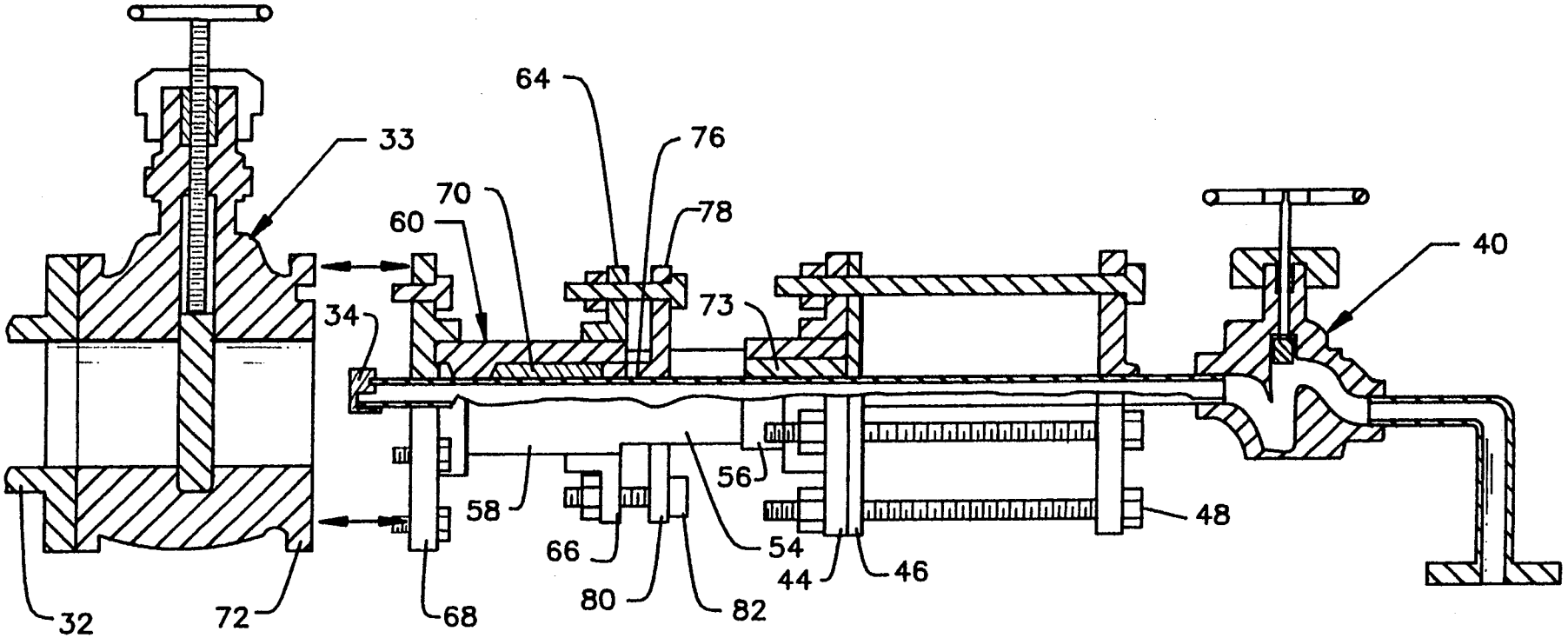
FIG. 6 is a selective cross-sectional view of the present invention desuperheater assembly shown in a detached relationship with a steam header connector flange.

Referring to FIG. 6, it can be seen that the entire desuperheater assembly can be removed from the gate valve 33. To remove the assembly, the control valve 40 is slowly opened. This releases the steam trapped between the gate valve 33 and the control valve 40. Once the trapped steam is vented, the connector flange 68 of the connector assembly 50 can be removed from the end flange 72 of the gate valve 33. Once removed, the spray nozzle 34 can be accessed, thereby allowing maintenance of the spray nozzle 34 without isolating the steam header 30. Furthermore, different sized spray nozzles 34 can be quickly interchanged if the steam flow within the steam header 30 is increased or decreased beyond calculated flows.

To replace the desuperheater assembly, the above removal process is essentially reversed. The control valve 40 is first closed. The connector flange 68 of the connector assembly 50 is then bolted onto the end flange 72 of the gate valve 33. The gate valve 33 is then opened slightly and the entire assembly checked for escaping steam. If steam is detected leaking past the packing gasket 70, the tamping bracket 74 is tightened until the leaking steam stops. The gate valve 33 is then opened fully and the elongated bolts 48 are tightened, driving the spray nozzle 34 into the steam header 30. The supply pipe 36 is then bolted to the water supply line 38 and the control valve 40 is opened, allowing the water to be sprayed into the steam header.

In the described embodiment, the supply pipe 36 was reciprocally moved back and forth past the gate valve 33, utilizing the selective rotation of the elongated bolts 48. It will be understood that any plurality of bolts may be used other than is shown. Furthermore, the use of elongated bolts 48 simply expresses a cost efficient way of selectively varying the distance between the supply pipe connector flange 42 and the face flange 44 of the connector assembly 50. As such, it will be understood that other devices that can be varied in length, such as hydraulic or pneumatic cylinder or a stepper drive shaft motor can be used in place of the described bolts to control the position of the pipe connector flange 42 relative the below lying connector assembly 50.

The present invention assembly allows the overall desuperheater performance to be optimized through timely maintenance. This helps a facility optimize the use of its process steam and decreases the amount of energy wasted through the inefficient preparation of process steam. It will be understood that the present invention desuperheater device described herein is merely exemplary and that a person skilled in the art may make many variations and modifications to the described embodiment utilizing functionally equivalent components to those described. All such variations and modifications are intended to be included within the scope of this invention as defined by the appended claims.

What is claimed is:

1. A desuperheating device for desuperheating steam flowing through a steam header at an elevated pressure, wherein the interior of said steam header is accessible through a valved opening, said desuperheater device comprising:

a hollow member mountable to said valved opening, said hollow member defining an internal lumen having a tapered region that tapers from a first diameter to a smaller second diameter, wherein said hollow member has a plurality of apertures formed therein that extend into said internal lumen proximate said tapered region and a plurality of flange members that radially extent away from said hollow member proximate the apertures;

a fluid conduit disposed in said hollow member, said fluid conduit having a distal end for discharging fluid flowing through said fluid conduit;

positioning means coupled between said hollow member and said fluid conduit, wherein said positioning means moves said distal end of said fluid conduit relative said hollow member between a first position external of said steam header, and a second position within said steam header;

a sealing element disposed in said hollow member around said fluid conduit;

a tamping element disposed within said hollow member, said tamping element having a plurality of bracket members radially extending therefrom that extend through said plurality of apertures in said hollow member, whereby the relative movement of said tamping element with respect to said tubular member is limited by the presence of the bracket members within the apertures; and fastening means for fastening said plurality of bracket members extending from said tamping element to said plurality of flange members extending from said hollow member, wherein said fastening means moves said tamping element with respect to said hollow member, thereby selectively advancing said tamping element against said sealing element, wherein said advancing means selectively compresses said sealing means between a first compressive force, where steam is permitted to pass between said fluid conduit and said sealing element, and a second compressive force where said sealing element is biased against said fluid conduit by said tapered region creating a steam impervious seal around said fluid conduit.

2. The device according to claim 1, further including a valving means coupled to said fluid conduit for selectively controlling the flow of fluid therethrough.

3. The device according to claim 1, wherein said tamping element includes a generally tubular region that surrounds said fluid conduit in said hollow member.

4. The device according to claim 1, wherein said fastening means includes threaded fasteners that join said plurality of flange members on said hollow member to said plurality of bracket members on said tamping element.

5. The device according to claim 1, further including bearing means disposed between said fluid conduit and said hollow member, wherein said bearing means prohibits the lateral movement of said fluid conduit relative said hollow member as said fluid conduit is moved between said first position and said second position.

* * * * *